US010018193B2

(12) United States Patent
Lastra

(10) Patent No.: US 10,018,193 B2
(45) Date of Patent: Jul. 10, 2018

(54) PERISTALTIC SUBMERSIBLE PUMP

(71) Applicant: Saudi Arabian Oil Company, Dhahran (SA)

(72) Inventor: Rafael Lastra, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 376 days.

(21) Appl. No.: 14/499,417

(22) Filed: Sep. 29, 2014

(65) Prior Publication Data

US 2015/0093257 A1 Apr. 2, 2015

Related U.S. Application Data

(60) Provisional application No. 61/885,785, filed on Oct. 2, 2013.

(51) Int. Cl.
*F04B 43/12* (2006.01)
*F04B 47/00* (2006.01)
(Continued)

(52) U.S. Cl.
CPC ..... *F04B 43/12* (2013.01); *E21B 43/121* (2013.01); *E21B 43/128* (2013.01); *F04B 43/09* (2013.01);
(Continued)

(58) Field of Classification Search
CPC ..... F04B 43/08; F04B 43/09; F04B 43/095; F04B 43/0072; F04B 43/04; F04B 43/084;
(Continued)

(56) References Cited

U.S. PATENT DOCUMENTS 2,931,309 A * 4/1960 Bower ..... F04B 43/113 405/53
3,039,309 A * 6/1962 Vesper ..... F04B 43/1133 417/394
(Continued)

FOREIGN PATENT DOCUMENTS

EP 1602830 A1 12/2005
GB 2004331 A 3/1979
(Continued)

OTHER PUBLICATIONS

PCT Communication Relating to the Results of the Partial International Searching Authority; dated Dec. 5, 2014; International Application No. PCT/US2014/056756; International File Date: Sep. 22, 2014.

*Primary Examiner* — Alexander Comley
(74) *Attorney, Agent, or Firm* — Bracewell LLP; Constance Gall Rhebergen; Linda L. Morgan

(57) ABSTRACT

A system for displacing fluid inside of a tubular member includes at least one peristaltic pump. Each peristaltic pump includes an elongated core member with a longitudinal axis located within the tubular member. A flexible member surrounds, and is concentric to, the elongated core member. The flexible member has a plurality of circular bands disposed along a length of the flexible member, each circular band being moveable between a contracted condition with a minimal radius and an expanded condition with a maximal radius. An outer membrane covers the circular bands, forming a first fluid cavity between an outer surface of the outer membrane and an inner surface of the tubular member. The outer membrane is operable to generate peristaltic waves in the first fluid cavity by selectively moving each circular band between the contracted condition and the expanded condition.

20 Claims, 4 Drawing Sheets

(51) Int. Cl.

| | |
|---|---|
| ***F04B 43/09*** | (2006.01) |
| ***E21B 43/12*** | (2006.01) |
| *F04B 47/02* | (2006.01) |
| *F04B 47/04* | (2006.01) |
| *F04B 43/10* | (2006.01) |
| *F04B 43/113* | (2006.01) |

(52) U.S. Cl.
CPC ..... *F04B 43/095* (2013.01); *F04B 47/00* (2013.01); *F04B 43/10* (2013.01); *F04B 43/1133* (2013.01); *F04B 43/1136* (2013.01); *F04B 47/02* (2013.01); *F04B 47/04* (2013.01)

(58) Field of Classification Search
CPC ..... F04B 43/12; F04B 47/00; F04B 47/02; F04B 47/06; E21B 43/128; E21B 43/121
USPC ..... 417/322, 473, 474; 91/248; 92/92, 93, 92/94, 95
See application file for complete search history.

(56) References Cited

U.S. PATENT DOCUMENTS 3,418,940 A 12/1968 Martin
3,511,583 A * 5/1970 Brown ..... F04B 43/09 417/412
3,526,223 A 9/1970 Curtis
3,677,667 A * 7/1972 Morrison ..... F04B 43/09 417/474
4,115,036 A * 9/1978 Paterson ..... F04B 11/0075 417/322
4,395,719 A * 7/1983 Majewski ..... B41J 2/04555 310/357
4,432,699 A * 2/1984 Beckman ..... F04B 43/095 417/322
4,449,893 A * 5/1984 Beckman ..... F04B 43/095 417/322
4,451,209 A 5/1984 Phillips
4,482,347 A 11/1984 Borsanyi
4,580,952 A * 4/1986 Eberle ..... F04B 47/04 417/383
4,854,836 A 8/1989 Borsanyi
4,886,432 A * 12/1989 Kimberlin ..... F04B 47/08 417/478
4,961,689 A * 10/1990 Avramidis ..... F04F 5/14 417/118
4,974,674 A * 12/1990 Wells ..... E21B 43/121 166/107
5,040,955 A * 8/1991 Knutson ..... F04B 43/12 417/474
6,015,266 A 1/2000 Swatek
6,017,198 A * 1/2000 Traylor ..... E21B 17/028 166/105
6,071,088 A * 6/2000 Bishop ..... F04B 17/003 123/498
6,074,179 A * 6/2000 Jokela ..... F04B 43/04 417/322
6,357,552 B1 3/2002 Eitler
6,435,840 B1 * 8/2002 Sharma ..... F04B 43/043 417/322
7,150,325 B2 12/2006 Ireland et al.
7,352,111 B2 4/2008 Bagwell
7,362,032 B2 4/2008 Pelrine et al.
7,397,166 B1 * 7/2008 Morgan ..... F04B 43/1223 310/328
7,707,925 B2 * 5/2010 Morriss ..... F04B 43/113 417/521
8,034,046 B2 * 10/2011 Eidenschink ..... A61L 29/04 604/264
2002/0098098 A1 * 7/2002 Miesner ..... F04B 43/095 417/477.1
2004/0234401 A1 11/2004 Banister
2007/0025868 A1 * 2/2007 Swayze ..... F04B 43/08 417/474
2007/0128059 A1 * 6/2007 Bagwell ..... F04B 19/006 417/474
2007/0217931 A1 * 9/2007 Estes ..... F04B 43/082 417/474
2013/0136639 A1 5/2013 Simpson
2013/0216400 A1 8/2013 Bucher et al.

FOREIGN PATENT DOCUMENTS

WO 20110071960 A2 6/2011
WO 20130043477 A2 3/2013

* cited by examiner

PERISTALTIC SUBMERSIBLE PUMP

CROSS REFERENCE TO RELATED APPLICATION

This application claims priority to and the benefit of co-pending U.S. Provisional Application Ser. No. 61/885,785, filed Oct. 2, 2013, titled "Peristaltic Submersible Pump," the full disclosure of which is hereby incorporated herein by reference in its entirety for all purposes.

BACKGROUND

Field of the Invention

Embodiments of the invention relate to an artificial lift method and device describing a submersible peristaltic pump system and a method of its use. More specifically, embodiments of the invention relate to a peristaltic pump and method of its use.

Description of the Related Art

One method of producing hydrocarbon fluid from a well bore that lacks sufficient internal pressure for natural production is to utilize an artificial lift method. A string of tubing or pipe known as a production string suspends the submersible pumping device near the bottom of the well bore proximate to the producing formation. The submersible pumping device is operable to retrieve production zone fluid, impart a higher pressure into the fluid and discharge the pressurized production zone fluid into production tubing. Pressurized well bore fluid rises towards the surface motivated by difference in pressure.

A submersible pump system is installed during completion operations in a specifically designed well bore production zone. The production zone is a portion of the well bore in-between or below a packer or plug where hydrocarbons are produced for production. The packers and plugs isolate the portion of the well bore that is in fluid communication with the hydrocarbon-bearing formation from the remainder of the well bore. Fluid isolation of the production zone permits access, maintenance and even fluid isolation of the remainder of the well bore without disturbing the production zone.

However, the average run life of the current submersible pumping systems is about 3 years which is less than the average time such pumping systems are required to be used in a well. Since rig availability is an issue, many barrels produced fluids are deferred every year as a result of the months of waiting time to procure use of a rig for a submersible pump replacement.

SUMMARY

The systems and methods of the invention of provide a longer lasting submersible pumping system with capabilities similar to conventional submersible pumping systems. Embodiments of this invention can be installed without the use of a rig. Therefore, embodiments of this invention have advantages both as the original pumping system to be installed in a well, or as a backup or replacement pump.

A system for displacing fluid inside of a tubular member can have one or more peristaltic pumps. Each peristaltic pump can have an elongated core member with a longitudinal axis located within the tubular member. A flexible member surrounds and is concentric to the elongated core member. The flexible member has a plurality of circular bands disposed along a length of the flexible member, each circular band being moveable between a contracted condition with a minimal radius and an expanded condition with a maximal radius. An outer membrane covers the circular bands and forms a fluid cavity between an outer surface of the outer membrane and an inner surface of the tubular member. The outer membrane operable to generate peristaltic waves in the fluid cavity in response to selectively moving each circular band between the contracted condition and the expanded condition.

In certain embodiments, the flexible member also has a plurality of generally longitudinal strips extending along the length of the flexible member. At least a portion of each generally longitudinal strip is moveable generally radially relative to the longitudinal axis of the elongated core member. A control conduit can be in signal communication with each circular band and each generally longitudinal strip for signaling each circular band to move from the contracted condition to the expanded condition, and for signaling at least a portion of each generally longitudinal strip to move generally radially relative to the longitudinal axis of the elongated core member. In embodiments where there are multiple peristaltic pumps, the control conduit can transmit control signals and electrical power to the flexible member of each peristaltic pump independent from the control signals and electric power being transmitted to each other peristaltic pump. The elongated core member can be the control conduit.

The circular bands of each peristaltic pump can be made of electroactive polymer, metal, elastomer, plastic, semiconductor, and piezoelectric material. In some embodiments, each peristaltic pump can have a magnetic linear actuator and the flexible member can have a second fluid cavity filled with a magnetic fluid. Each circular band of each peristaltic pump can have an actuator to cause such circular band to selectively move from the contracted condition to the expanded condition. The system can include a sensor that can sense conditions within the tubular member, such as temperature, pressure and density.

In other embodiments of the current invention, a submersible pump system for displacing fluids within a subterranean well includes production tubing with a central bore located within the subterranean well. An elongated core member with a longitudinal axis is located within the central bore of the production tubing. The flexible member surrounds and is concentric to the elongated core member, the flexible member having the plurality of circular bands disposed along the length of the flexible member, the plurality of generally longitudinal strips extending along the length of the flexible member, and the outer membrane covering the circular bands and generally longitudinal strips and forming the fluid cavity between the outer surface of the outer membrane and the inner surface of the central bore of the production tubing.

The system also includes the control conduit for transmitting signals to the flexible member to cause the outer membrane to generate peristaltic waves in the fluid cavity by selectively expanding and contracting the diameter of each circular band and moving at least a portion of each generally longitudinal strip in a direction generally radial to the longitudinal axis of the elongated core member. The control conduit can be a cable for transmitting electric power to the flexible member. The control conduit can be located within the production tubing. Alternatively, a lower portion of the control conduit can be located within the production tubing and an upper portion of the control conduit can be located outside of the production tubing.

In yet other embodiments, the system also includes a plurality of actuators, each actuator coupled to at least one circular band and operable to cause such at least one circular band to move from its contracted condition to its expanded condition.

In yet other alternative embodiments of the current invention, a method for displacing fluids in a tubular member includes the step of inserting a submersible pump within the tubular member. The submersible pump includes: the elongated core member with the longitudinal axis, the tubular flexible member surrounding and concentric to the elongated core member, the flexible member comprising the plurality of circular bands disposed along the length of the flexible member; and the outer membrane covering the circular bands. Peristaltic waves can be generated within the tubular member by selectively moving each circular band between the contracted condition with the minimal radius and the expanded condition with the maximal radius, to displace the fluids within the tubular member along the length of the tubular member.

The peristaltic waves can be generated in a first fluid cavity formed between the outer surface of the outer membrane and the inner surface of the tubular member. Alternatively, the peristaltic waves can be generated in the second fluid cavity formed between the inner surface of the outer membrane and the outer surface of the elongated core member, or can be generated in both the first fluid cavity and the second fluid cavity.

In order to install the submersible pump, the submersible pump can be located within the tubular member proximal to an upper end of the tubular member. Selectively moving each circular band between the contracted condition and an expanded condition can cause the submersible pump to move itself along the length of the tubular member. The submersible pump can then be secured in a desired final location within the tubular member.

A control signal can be transmitted along the control conduit to cause each circular band to selectively move between the contracted condition and the expanded condition. Alternatively, the signal can be transmitted to actuators which in turn cause each circular band to selectively move between the contracted condition and the expanded condition. In some embodiments, the submersible pump also includes the plurality of generally longitudinal strips extending along the length of the flexible member and the control signal is transmitted along the control conduit to cause at least a portion of each generally longitudinal strip to move radially to generating peristaltic waves in the fluid cavity. The sensor can sense the temperature, pressure, and density within the tubular member.

In some embodiments, the second fluid cavity is filled with the magnetic fluid and each circular band can be selectively moved between the contracted condition and the expanded condition with the magnetic linear actuator.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION

The present invention will now be described more fully hereinafter with reference to the accompanying drawings, which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

Figure 1:
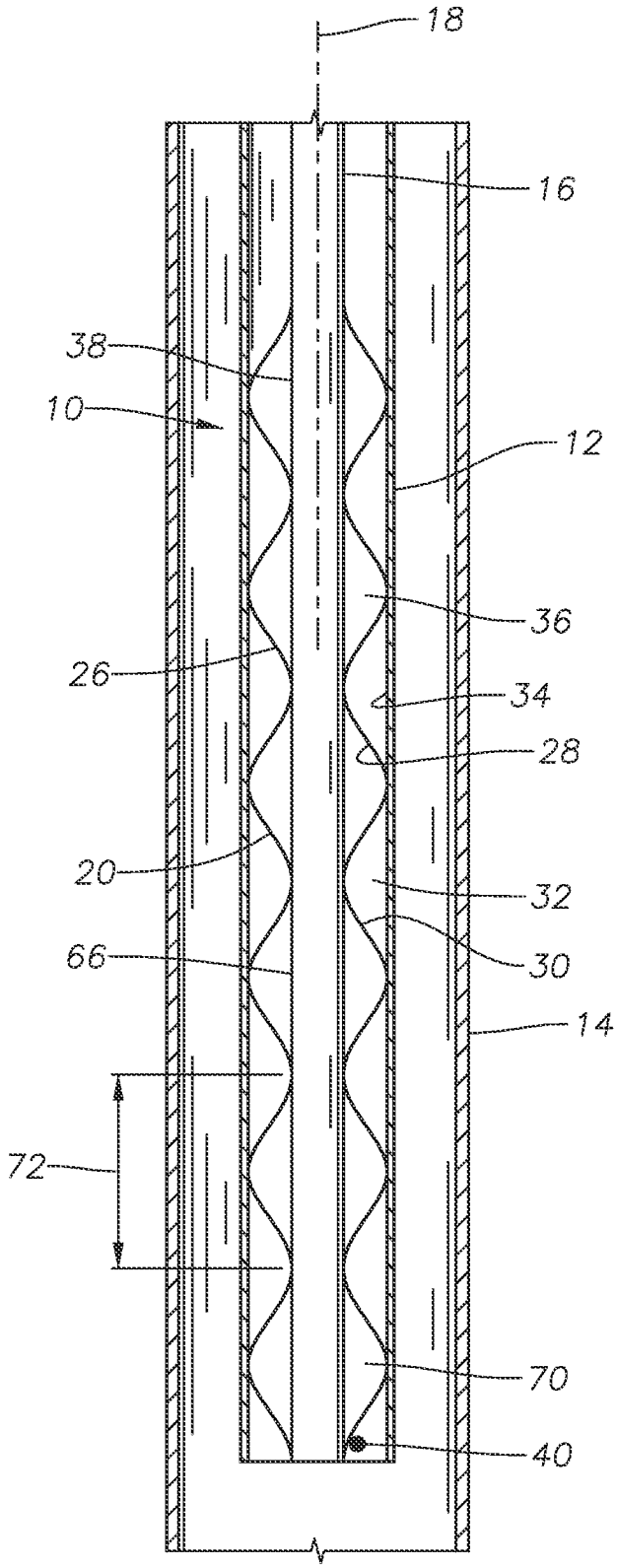
FIG. 1 is a sectional schematic representation of a submersible pump system with a peristaltic pump in accordance with an embodiment of the present invention.

Turning to FIG. 1, peristaltic pump 10 can be located within tubular member 12 for displacing the fluid inside of tubular member 12. Tubular member 12, may be, for example, production tubing used in subterranean well 14. Although only one peristaltic pump 10 is shown in the embodiment of FIG. 1, the system can include at least one peristaltic pump 10 or multiple peristaltic pumps 10 within tubular member 12. Multiple peristaltic pumps 10 can be controlled independently or be isolated in case of failure. In that way, if one of peristaltic pumps 10 fails it can be isolated. The failure of one peristaltic pump 10 in a system with multiple peristaltic pumps 10 will reduce the pressure rating of the system, but it will not affect the flow rate of the fluids within tubular member 12.

Elongated core member 16 with longitudinal axis 18 is located within tubular member 12. Flexible member 20 surrounds elongated core member 16. Flexible member 20 is located around and concentric to elongated core member 16. Elongated core member 16 is an elongated member that can be rigid or semi rigid and can be used as structural member to support flexible member 20.

Figure 2:
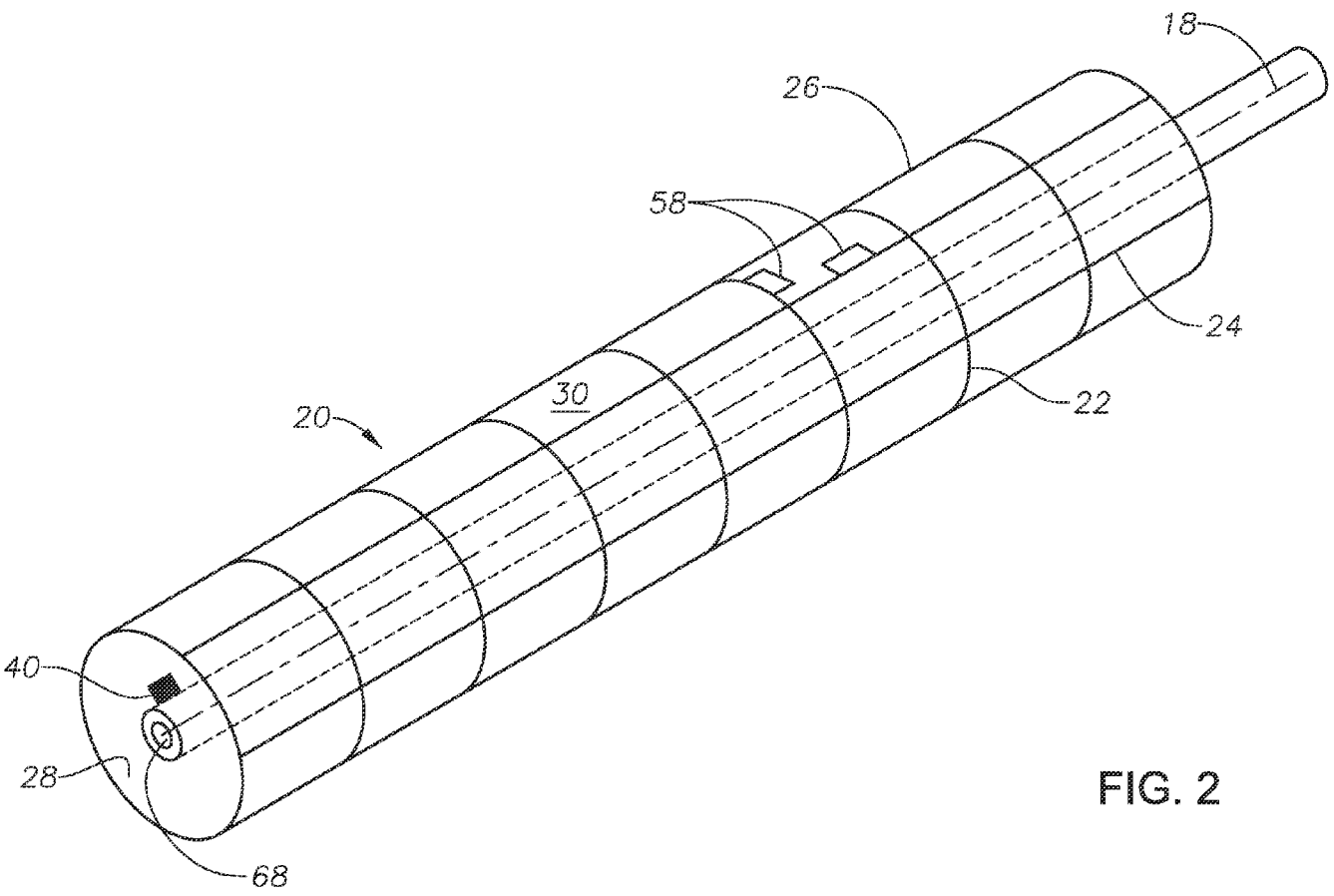
FIG. 2 is a perspective view of a peristaltic pump in accordance with an embodiment of the present invention.

As can be seen in FIG. 2, a number of circular bands 22 are spaced along the length of flexible member 20. In some embodiments, flexible member 20 can also have a number of generally longitudinal strips 24 which extend along the length of flexible member 20 and run generally perpendicular to circular bands 22. In various embodiments, flexible member 20 can have only circular bands 22, or only generally longitudinal strips 24, or a combination thereof. As used herein, the term "generally longitudinal" means that the member as a whole extends in a direction that is overall substantially in the same direction of longitudinal axis 18, while allowing for deviations from being perfectly parallel to longitudinal axis 18. As an example, generally longitudinal strips 24 can be wound along the length of flexible member 20 so that they are not necessarily perpendicular to circular bands 22, such as being wound in a helical type pattern along the length of flexible member 20. So while portions of generally longitudinal strops 24 may not be parallel to longitudinal axis 18, generally longitudinal strips 24 as a whole extend along a length of flexible member 20 in an overall longitudinal direction.

The circular bands 22 and generally longitudinal strips 24 act as both strength members, to provide mechanical structure flexible member 20, and as actuators with the ability to expand, contract or move radially at command. It is the movement of circular bands 22 and generally longitudinal strips 24 which generate the peristaltic waves, as will be discussed in further detail below. Circular bands 22 and generally longitudinal strips 24 can be passive, relying on external electrical, hydraulic or mechanical actuators 58 to cause their movement. Alternatively, circular bands 22 and generally longitudinal strips 24 can be active, acting as both strength members and actuators at the same time, being capable of movement themselves.

The circular bands 22 and generally longitudinal strips 24 are surrounded by an outer membrane 26. Outer membrane 26 isolates and protects the internal elements of flexible member 20. Outer membrane 26 can be made of a variety of elastic flexible material including elastomers, plastics, and metals. Outer membrane 26 could also be a semiconductor. Outer membrane 26 has an inner surface 28 and an outer surface 30. Generally longitudinal strips 24, circular bands 22 and outer membrane 26 can each be formed from a variety of materials, including metals, elastomers, and plastics. Generally longitudinal strips 24, circular bands 22 and outer membrane 26 can also be formed of electroactive polymers or piezoelectric material or can be semiconductors.

Returning to FIG. 1, first fluid cavity 32 is an annular space formed between outer surface 30 of outer membrane 26 and an inner surface 34 of tubular member 12. Second fluid cavity 36 is a second annular space formed between inner surface 28 of outer membrane 26 and an outer surface 38 of elongated core member 16. Outer membrane 26 can therefore be used to generate peristaltic waves in fluids which are located in either first fluid cavity 32, second fluid cavity 36 or in both fluid cavities 32, 36. The peristaltic waves will generate a number of sub-cavities 70 with a length equal to wavelength 72 of the peristaltic wave.

Each peristaltic pump can also have at least one sensor 40 one or more sensors 40 for monitoring conditions within tubular member 12. Sensors 40 may measure, for example, pressure, temperature, or density. With the use of multiple sensors 40, the peristaltic pump system can be used as a distributed sensing array. As can also be seen in FIG. 2, elongated core member 16 can have an internal bore 68. Elongated core member 16 can be used itself as a conduit for the transmission of electrical power, telemetry and control signals to flexible member 20, as well as for transmitting data from sensors 40. Alternatively, elongated core member 16 can house various cables for the transmission of electrical power, telemetry and control signals to flexible member 20, as well as for transmitting data from sensors 40.

Figure 3:
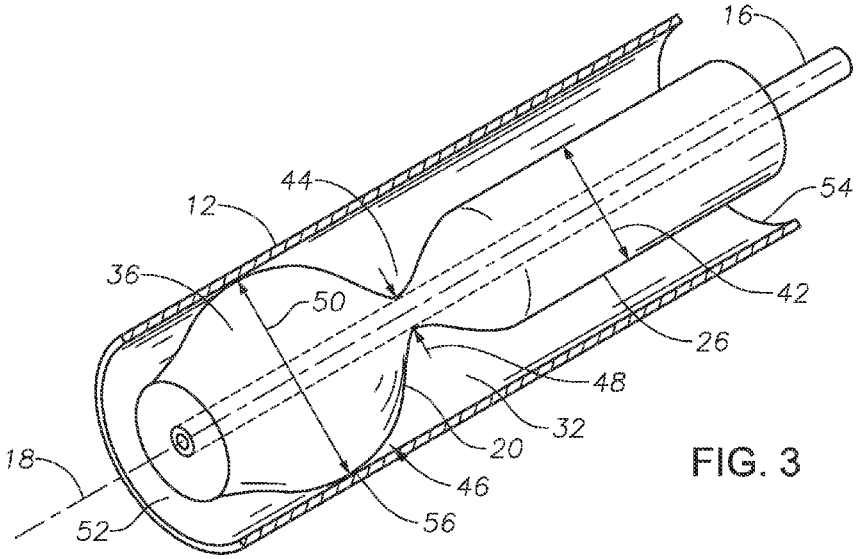
FIG. 3 is a perspective view of a portion of a peristaltic pump with a first peristaltic wave being formed in accordance with an embodiment of the present invention.

Peristaltic waves are produced by sequentially changing the outer diameter of flexible member 20 along its length. The fluids trapped between the crests (or the depressions) of two consecutive waves is displaced in the same direction of movement of the peristaltic waves. Turning now to FIG. 3, diameter 42 of the relaxed flexible member 20 is shown. Trough 44 of first wave 46 is formed by flexible member 20. This can be accomplished by selectively contracting the diameter of certain circular bands 22 in the vicinity of trough 44. For example, circular bands 22 can each be moveable to the contracted condition with minimal radius 48. At least a portion of each generally longitudinal strip 24 can also be moved inward in a direction generally radial relative to longitudinal axis 18 to take on the desired wave form. As used herein, the term "generally radial" is meant to indicate a direction that is substantially normal to longitudinal axis 18, but allows for deviations from being perfectly normal to longitudinal axis 18.

Crest 56 of first wave 46 can be formed by selectively expanding certain circular bands 22 in the vicinity of crest 56, for example, by moving such circular band 22 to an expanded condition with maximal radius 50. In some embodiments, at least a portion of each generally longitudinal strip 24 can also be moved outward in a direction generally radial to longitudinal axis 18 of elongated core member 16.

Figure 4:
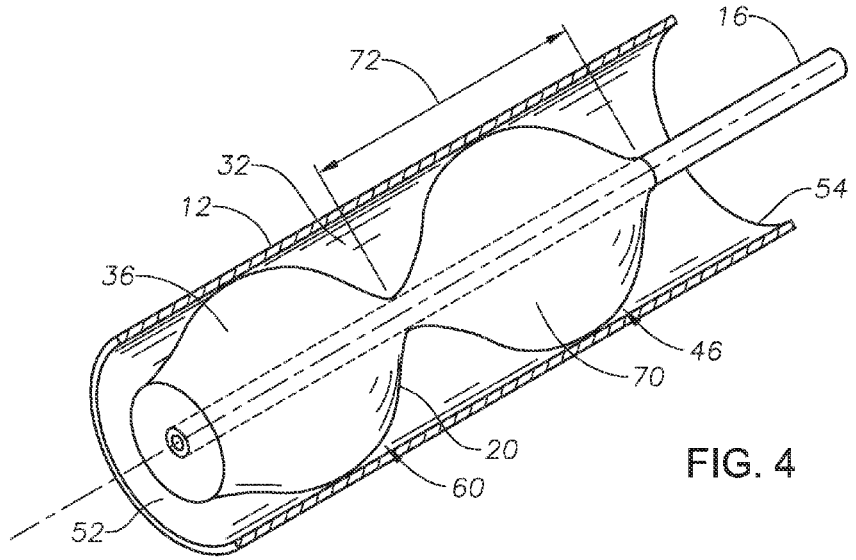
FIG. 4 is a perspective view of a portion of a peristaltic pump with a first and second peristaltic wave being formed in accordance with an embodiment of the present invention.

Turning to FIG. 4, as the process continues, first wave 46 continues along the length of flexible member 20 from first end 52 of tubular member 12 towards second end 54 of flexible member 20. As first wave 46 travels along the length of flexible member 20, the fluids trapped within first fluid cavity 32, or second fluid cavity 36, or both, will be pumped along the length of the tubular member in a direction from first end 52 towards second end 54. First end 52 could therefore be a fluid intake and second end 54 could be a fluid discharge. In some embodiments, first fluid cavity 32 contains the fluid to be pumped and second fluid cavity 36 is filled with a separate fluid for pressure compensation purposes.

A second wave 60 is formed behind first wave 46 in a similar manner as described above and the waving make process can continue indefinitely as additional sequential waves are generated. It should be understood that flexible member 20 does not move axially relative to axis longitudinal during this process. Rather troughs 44 and crests 56 are created sequentially along the length of flexible member 20 in a direction from first end 52 to second end 54 of flexible member 20 by radially displacing outer membrane 26 by radial movement of circular bands 22 and generally longitudinal strips 24. This process creates the peristaltic wave in the same direction.

Figure 5:
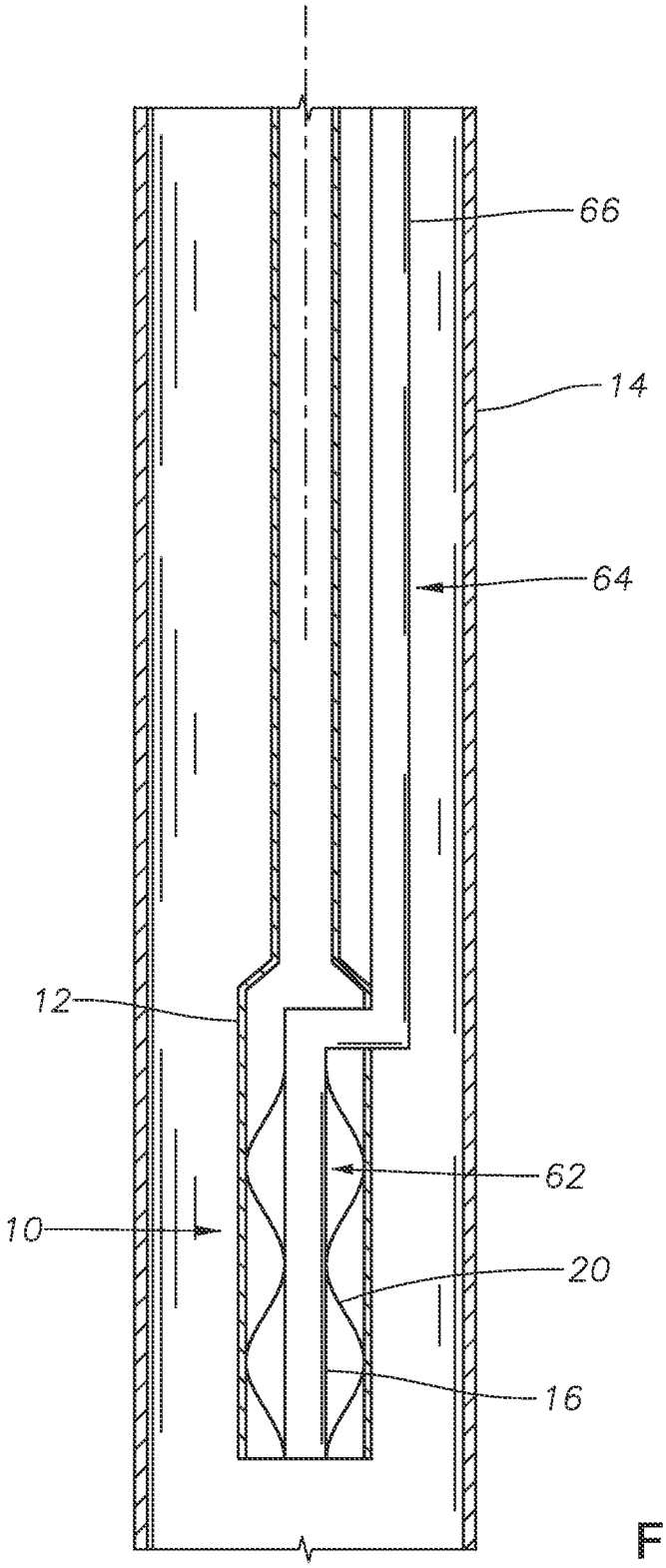
FIG. 5 is a sectional schematic representation of a submersible pump system with a peristaltic pump in accordance with an alternative embodiment of the present invention.

An alternative embodiment is shown in FIG. 5. In this embodiment, control conduit 66 comprises lower control portion 62 and an upper control portion 64. Lower control portion 62 is located within tubular member 12 can be elongated core member 16 or can be contained within elongated core member 16. Upper control portion 64 of control conduit 66 is located outside of tubular member 12 and can be strapped to outside of tubular member 12. In this configuration, a diameter of tubular member 12 can be smaller above where control conduit 66 exits tubular member 12 than the diameter of tubular member 12 below where control conduit 66 exits tubular member 12.

Turning back to FIG. 1, in an example of operation, one or more peristaltic pumps 10 can be located inside of tubular member 12. Each peristaltic pump 10 can be located within tubular member 12 by conventional means. For example, in the case of tubular member 12 being located within 30 subterranean well 14, each peristaltic pump 10 could be lowered through tubular member 12 with the drilling rig or by wireline or coiled tubing.

In alternative embodiments, each peristaltic pump 10 could propel itself through tubular member 12. In such an embodiment, peristaltic pump 10 would be located within tubular member 12 proximal to an accessible end of tubular member 12. Each circular band 22 could then be moved between the contracted condition and the expanded condition to generate the peristaltic wave and cause peristaltic pump 10 to move itself along tubular member 12. In embodiments where peristaltic pump 10 has generally longitudinal strips 24, selective radial movement of portions of generally longitudinal strips 24 would be coordinated with movement of circular bands 22 to generate the peristaltic waves. In an ideal embodiment, the peristaltic movement is initiated by circular bands 22 contracting followed by a radial movement of a portion of flexible members 20 which pushes peristaltic pump 10 forward. This is conceptually similar to how earthworms drive their locomotion. This embodiment is particularly suitable for retrofitting naturally flowing wells with artificial lift and for allowing for rigless, self-deployment and intervention.

Regardless of the method of locating each peristaltic pump 10 in tubular member 12, once peristaltic pump 10 reaches its desired location within tubular member 12, it could be secured in place, for example, by the use of anchors or tubing profiles designed for that purpose and pumping operations can begin by generating peristaltic waves within tubular member 12. In order to generate the peristaltic waves, circular band 22 can be selectively and successively moved between the contracted condition with a minimal radius 48 and an expanded condition with maximal radius 50, to displace the fluids within tubular member 12 along a length of tubular member 12. In embodiments where flexible member 20 has generally longitudinal strips 24, at least a portion of each generally longitudinal strip 24 can be selectively moved radially to assist in generating the peristaltic waves. The fluids can be displaced either within first fluid cavity 32, second fluid cavity 36, or within both fluid cavities 32, 36.

A control conduit 66 is in signal communication with each circular band 22 and each generally longitudinal strip 24 for controlling each circular band 22 and causing each circular band 22 to move from the contracted condition to the expanded condition. Control conduit 66 can be elongated core member 16. Elongated core member 16 can be capable of transmitting control signals itself, or elongated core member 16 can contain cables within internal bore 68 of elongated core member 16. Alternatively, cables may be otherwise secured to elongated core member 16. Control conduit 66 can also provide a signal to control at least a portion of each generally longitudinal strip 24 to cause the portion of each generally longitudinal strip 24 to move generally radially relative to longitudinal axis 18 of elongated core member 16. Control conduit 66 can also transmit electrical power to each peristaltic pump 10 and can collect and transmit data, such as temperature, pressure and density, from sensors 40. Therefore, in embodiments of this disclosure, control conduit 66, which can provide control signals and power, is a self-contained element of peristaltic pump 10. The self-contained system of peristaltic pump 10 can be manufactured as an elongated tubular member and coiled around a spool to provide peristaltic pump 10 as a roll, in a manner similar to traditional coiled tubing, for ease of shipping and deployment.

In some embodiments, a number of peristaltic pumps 10 can be located within tubular member 12. Peristaltic pumps 10 can be spaced apart within tubular member 12, or peristaltic pumps 10 can abut each other. Control conduit 66 can transmit control signals and electrical power to flexible member 20 of each peristaltic pump 10 independent from the control signals and electric power being transmitted to each other peristaltic pump 10. An operator can control the operation of each peristaltic pump 10 independently. If one peristaltic pump 10 was to fail, that peristaltic pump 10 can be isolated from the rest.

In embodiments where circular bands 22 and generally longitudinal strips 24 are passive, external electrical, hydraulic or mechanical actuators 58 can be signaled to actuate and cause movement of circular bands 22 and generally longitudinal strips 24. Each peristaltic pump 10 can have a plurality of actuators 58. Each actuator 58 can be coupled to at least one circular band 22 and can be actuated to cause such circular bands 22 to move from their contracted condition to their expanded condition. Some actuators 58 can alternatively be coupled to at least one generally longitudinal strip 24 and be actuated to cause a portion of such generally longitudinal strips 24 to move in a direction generally radial to longitudinal axis 18 of elongated core member 16. In embodiments where second fluid cavity 36 is filled with a separate fluid, this fluid can be a magnetic fluid and actuators 58 can be magnetic linear actuators.

Alternatively, where circular bands 22 and generally longitudinal strips 24 are active, circular bands 22 and generally longitudinal strips 24 can be signaled directly. In some embodiments, outer membrane 26 may itself be capable of independent movement and in such embodiment, a signal would also be sent to outer membrane 26. In embodiments where circular bands 22 and generally longitudinal strips 24 are active, circular bands 22 and generally longitudinal strips 24, as well as outer membrane 26 can be made out of electroactive polymers. These materials exhibit deformation response to an applied electric field. This deformation property can be used to control the movement of flexible member 20.

If desired, the operator can also use peristaltic pump 10, as a fluid control device when peristaltic pump 10 is shut in. By signaling each elongated core member 16 to move to an expanded condition and signaling each flexible member 20 to move radially outward relative to longitudinal axis 18, outer surface 30 of outer membrane 26 will be in contact with inner surface 34 of tubular member 12 along the length of peristaltic pump 10. In this static expanded condition, flexible member 20 creates a fluid barrier within tubular member 12 with a pressure rating proportional to the number of sub-cavities 70 or the length of flexible member 20.

The fluid flow rate of peristaltic pump 10 is proportional to the volume of first fluid cavity 32 volume (where the pumped fluid is located in the first fluid cavities 32) and the frequency of the peristaltic waves. Because peristaltic pump 10 is a linear positive displacement pump, there is little disturbance is created in the pumped fluid, preventing the possibility of change of the flow regime, formation of emulsions or triggering the formation of scales. Peristaltic pump 10 can generate high pressure even at low rates and it is intrinsically more efficient than current other artificial lift systems The pressure rating of peristaltic pump 10 is directly proportional to the number of sub-cavities 70. Increasing the number of sub-cavities 70 reduces the possibility of fluid slippage. Because the expansion and contraction movements of flexible member 20 are radial, there is no axial displacement of flexible member 20 during the pumping cycle. This means that there is near zero mechanical friction losses between flexible member 20 and tubular member 12, reducing or eliminating the wear of flexible member 20 and peristaltic pump 10 is able to handle a relatively high amount of fines or abrasives.

The systems and methods of this disclosure are suitable to operate inside in highly deviated wells at any inclination and can operate inside deformed tubular members. The system and method of this disclosure has similar capabilities to conventional submersible pumping systems but its simpler design and the lifting methodology makes it intrinsically more reliable. In addition to this, the design of the proposed system of this disclosure is inherently suitable for alternative deployment methods eliminating the dependency on rig availability. In addition to its use for pumping fluids in subterranean fluids, the system and methods described in this disclosure may also be applied in other pumping applications, such as for various industrial and medical uses.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for displacing fluid inside of a tubular member, the system comprising at least one peristaltic pump, the at least one peristaltic pump comprising:

an elongated core member with a longitudinal axis located within a tubular member;

a flexible member surrounding and concentric to the elongated core member, the flexible member having:

a plurality of controllable circular bands disposed along a length of the flexible member, each of the controllable circular bands being moveable between a contracted condition with a minimal radius and an expanded condition with a maximal radius, and a plurality of controllable generally longitudinal strips spaced circumferentially apart and extending along the length of the flexible member, at least a portion of each of the controllable generally longitudinal strips being moveable generally radially relative to the longitudinal axis of the elongated core member, wherein the generally longitudinal strips comprise a material that deforms in response to an electrical field applied to the material; and an outer membrane covering the controllable circular bands and forming a first fluid cavity between an outer surface of the outer membrane and an inner surface of the tubular member, the outer membrane operable to generate peristaltic waves in the first fluid cavity in response to selectively moving each of the controllable circular bands between the contracted condition and the expanded condition.

2. The system of claim 1, further comprising a control conduit in signal communication with each of the controllable circular bands and each of the controllable generally longitudinal strips for signaling each of the controllable circular bands to move from the contracted condition to the expanded condition, and for directly signaling at least a portion of each of the controllable generally longitudinal strips to move generally radially relative to the longitudinal axis of the elongated core member.

3. The system of claim 1, wherein the at least one peristaltic pump includes more than one peristaltic pump, and further comprising a control conduit for transmitting control signals and electrical power to the flexible member of one of the more than one peristaltic pumps independent from the control signals and electric power being transmitted to each of the other of the more than one peristaltic pumps.

4. The system of claim 1, wherein the elongated core member of the at least one peristaltic pump comprises a control conduit for transmitting electric power and control signals to the flexible member.

5. The system of claim 1, wherein the at least one peristaltic pump further comprises a magnetic linear actuator and the flexible member of the at least one peristaltic pump comprises a second fluid cavity, the second fluid cavity being filled with a magnetic fluid.

6. The system of claim 1, wherein the controllable circular bands of the at least one peristaltic pump comprise a material selected from a group consisting of electroactive polymer, metal, elastomer, plastic, semiconductor, and piezoelectric material.

7. The system of claim 1, wherein each of the controllable circular bands of the at least one peristaltic pump comprises an actuator to cause such circular band to selectively move from the contracted condition to the expanded condition.

8. The system of claim 1, further comprising at least one sensor for sensing a condition selected from a group consisting of temperature, pressure and density.

9. The system of claim 1, wherein the generally longitudinal strips comprise an electroactive polymer.

10. A method for displacing fluids in a production tubing, the method comprising the steps of:

(a) lowering a submersible pump into a subterranean well through a central bore of a production tubing, the submersible pump comprising: an elongated core member with a longitudinal axis that supports a flexible member, the flexible member surrounding and concentric to the elongated core member and comprising a plurality of circular bands disposed along a length of the flexible member; and an outer membrane covering the circular bands; and (b) generating peristaltic waves within the production tubing by selectively moving each of the circular bands between a contracted condition with a minimal radius so that the flexible member is proximate to the elongated core member, and an expanded condition with a maximal radius so that the flexible member is proximate to an inner surface of the central bore of the production tubing, to displace the fluids within the production tubing along a length of the production tubing.

11. The method of claim 10, wherein step (b) comprises generating the peristaltic waves in a first fluid cavity formed between an outer surface of the outer membrane and an inner surface of the production tubing.

12. The method of claim 10, wherein step (b) comprises generating the peristaltic waves in a second fluid cavity formed between an inner surface of the outer membrane and an outer surface of the elongated core member.

13. The method of claim 10, wherein step (b) comprises generating the peristaltic waves both in a first fluid cavity formed between an outer surface of the outer membrane and an inner surface of the production tubing, and in a second fluid cavity formed between an inner surface of the outer membrane and an outer surface of the elongated core member.

14. The method of claim 10, wherein step (a) comprises:

locating the submersible pump within the production tubing proximal to an upper end of the production tubing;

selectively moving each of the circular bands between the contracted condition and the expanded condition to cause the submersible pump to propel itself a distance axially within the production tubing; and securing the submersible pump in a desired final location within the production tubing.

15. The method of claim 10, wherein step (b) comprises transmitting a control signal along a control conduit to cause each of the circular bands to selectively move between the contracted condition and the expanded condition.

16. The method of claim 10, wherein the submersible pump further comprises a plurality of generally longitudinal strips extending along the length of the flexible member and step (b) further comprises transmitting a control signal along a control conduit to cause at least a portion of each of the generally longitudinal strips to move radially to generate the peristaltic waves in a fluid cavity.

17. The method of claim 10, wherein step (b) comprises transmitting a control signal along a control conduit to actuate an actuator to cause each of the circular bands to selectively move between the contracted condition and the expanded condition.

18. The method of claim 10, further comprising sensing a condition within the production tubing with a sensor, the condition being selected from a group consisting of temperature, pressure, and density.

19. The method of claim 10, wherein a second fluid cavity formed between an inner surface of the outer membrane and an outer surface of the elongated core member is filled with a magnetic fluid and step (b) further comprises selectively moving each of the circular bands between the contracted condition and the expanded condition with a magnetic linear actuator.

20. The method of claim 10, further comprising moving each of the circular bands to the expanded condition, and maintaining all of the circular bands simultaneously in the expanded condition to form a fluid barrier within the production tubing over a length of the outer membrane.

* * * * *